US009011614B2

(12) United States Patent
Nakagaito et al.

(10) Patent No.: US 9,011,614 B2
(45) Date of Patent: Apr. 21, 2015

(54) HIGH-STRENGTH GALVANIZED STEEL SHEET WITH EXCELLENT FORMABILITY AND METHOD FOR MANUFACTURING THE SAME

(75) Inventors: Tatsuya Nakagaito, Fukuyama (JP); Saiji Matsuoka, Kurashiki (JP); Yoshitsugu Suzuki, Fukuyama (JP); Yuki Toji, Fukuyama (JP)

(73) Assignee: JFE Steel Corporation (JP)

( * ) Notice: Subject to any disclaimer, the term of this patent is extended or adjusted under 35 U.S.C. 154(b) by 864 days.

(21) Appl. No.: 12/866,469

(22) PCT Filed: Jan. 28, 2009

(86) PCT No.: PCT/JP2009/051824

§ 371 (c)(1),
(2), (4) Date: Nov. 1, 2010

(87) PCT Pub. No.: WO2009/099079

PCT Pub. Date: Aug. 13, 2009

(65) Prior Publication Data

US 2011/0198002 A1 Aug. 18, 2011

(30) Foreign Application Priority Data

Feb. 8, 2008 (JP) ..... 2008-028376

(51) Int. Cl.

| | |
|---|---|
| ***C22C 38/00*** | (2006.01) |
| ***C22C 38/08*** | (2006.01) |
| ***C22C 38/18*** | (2006.01) |
| ***C23C 2/02*** | (2006.01) |
| ***C22C 38/02*** | (2006.01) |
| ***C21D 1/25*** | (2006.01) |
| ***C21D 6/00*** | (2006.01) |
| ***C21D 8/04*** | (2006.01) |
| ***C22C 38/04*** | (2006.01) |
| ***C22C 38/06*** | (2006.01) |

(52) U.S. Cl.

CPC . *C22C 38/02* (2013.01); *C21D 1/25* (2013.01); *C21D 6/005* (2013.01); *C21D 6/008* (2013.01); *C21D 8/0426* (2013.01); *C21D 8/0436* (2013.01); *C21D 8/0463* (2013.01); *C21D 2211/002* (2013.01); *C21D 2211/005* (2013.01); *C21D 2211/008* (2013.01); *C22C 38/04* (2013.01); *C22C 38/06* (2013.01)

(58) Field of Classification Search

USPC ..... 148/320, 331–335, 330, 533, 603; 420/83–84, 89–93, 104–106, 108–109, 420/119, 121, 126–127; 428/659

IPC ..... C21D 1/25,2211/002, 2211/005, 2211/008, C21D 6/005

See application file for complete search history.

(56) References Cited

FOREIGN PATENT DOCUMENTS

| | | | | |
|---|---|---|---|---|
| EP | 1 512 760 | | | 3/2005 |
| JP | 03-94017 | | | 4/1991 |
| JP | 6-093340 | A | | 4/1994 |
| JP | 11-279691 | A | | 10/1999 |
| JP | 2001-192768 | | | 7/2001 |
| JP | 2001-207235 | | | 7/2001 |
| JP | 2001-207236 | | | 7/2001 |
| JP | 2002-302734 | A | | 10/2002 |
| JP | 2002302734 | A | * | 10/2002 |
| JP | 2003-096541 | | | 4/2003 |
| JP | 2003-193190 | A | | 7/2003 |
| JP | 2004-091924 | A | | 3/2004 |
| JP | 2004091924 | A | * | 3/2004 |
| JP | 2005-206919 | A | | 8/2005 |
| JP | 2005206919 | A | * | 8/2005 |
| JP | 2005-336526 | A | | 12/2005 |
| JP | 2005336526 | A | * | 12/2005 |

OTHER PUBLICATIONS

European Supplementary Search Report dated Nov. 22, 2013 for European Patent Application No. EP 09 70 9141.

* cited by examiner

*Primary Examiner* — Sikyin Ip
(74) *Attorney, Agent, or Firm* — DLA Piper LLP (US)

(57) ABSTRACT

A high-strength galvanized steel sheet has excellent mechanical properties such as a TS of 1200 MPa or more, an El of 13% or more, and a hole expansion ratio of 50% or more and a method for manufacturing the same. A high-strength galvanized steel sheet excellent in formability contains 0.05% to 0.5% C, 0.01% to 2.5% Si, 0.5% to 3.5% Mn, 0.003% to 0.100% P, 0.02% or less S, and 0.010% to 0.5% Al on a mass basis, the remainder being Fe and unavoidable impurities, and has a microstructure which contains 0% to 10% ferrite, 0% to 10% martensite, and 60% to 95% tempered martensite on an area basis as determined by structure observation and which further contains 5% to 20% retained austenite as determined by X-ray diffractometry.

20 Claims, No Drawings

HIGH-STRENGTH GALVANIZED STEEL SHEET WITH EXCELLENT FORMABILITY AND METHOD FOR MANUFACTURING THE SAME

RELATED APPLICATIONS

This is a §371 of International Application No. PCT/JP2009/051824, with an inter-national filing date of Jan. 28, 2009 (WO 2009/099079 A1, published Aug. 13, 2009), which is based on Japanese Patent Application No. 2008-028376, filed Feb. 8, 2008, the subject matter of which is incorporated by reference.

TECHNICAL FIELD

This disclosure relates to high-strength galvanized steel sheets, used in the automobile and electrical industries, excellent in formability. The disclosure particularly relates to a high-strength galvanized steel sheet having a tensile strength TS of 1200 MPa or more, an elongation El of 13% or more, and a hole expansion ratio of 50% or more and also relates to a method for manufacturing the same. The hole expansion ratio is an index of stretch frangeability.

BACKGROUND

In recent years, it has been an important issue to improve the fuel efficiency of automobiles in view of global environmental conservation. Therefore, it has been actively attempted that steel sheets which are materials for automobile bodies are increased in strength and reduced in thickness such that light-weight automobile bodies are achieved. However, the increase in strength of the steel sheets causes a reduction in ductility of the steel sheets, that is, reduction in the formability thereof. Hence, the following sheets are demanded: galvanized steel sheets having high strength, high formability, and excellent corrosion resistance.

The following sheets have been developed to cope with such a demand: multi-phase high-strength galvanized steel sheets such as DP (dual phase) steel sheets having ferrite and martensite and TRIP (transformation-induced plasticity) steel sheets based on the transformation-induced plasticity of retained austenite. For example, JP 11-279691 proposes a high-strength galvanized steel sheet having good formability. The sheet contains 0.05% to 0.15% C, 0.3% to 1.5% Si, 1.5% to 2.8% Mn, 0.03% or less P, 0.02% or less S, 0.005% to 0.5% Al, and 0.0060% or less N on a mass basis, the remainder being Fe and unavoidable impurities; satisfies the inequalities (Mn %)/(C %)≥15 and (Si %)/(C %)≥4; and has a ferrite matrix containing 3% to 20% martensite and retained austenite on a volume basis. DP and TRIP steel sheets contain soft ferrite and, therefore, have a problem that a large amount of an alloy element is necessary to achieve a large tensile strength TS of 980 MPa or more and a problem that stretch frangeability, which needs to be high for stretch flanging, is low because an increase in strength increases the difference in hardness between ferrite and a second phase.

JP 2003-193190 proposes a high-strength galvanized steel sheet excellent in stretch frangeability. That sheet contains 0.01% to 0.20% C, 1.5% or less Si, 0.01% to 3% Mn, 0.0010% to 0.1% P, 0.0010% to 0.05% S, 0.005% to 4% Al, and one or both of 0.01% to 5.0% Mo and 0.001% to 1.0% Nb on a mass basis, the remainder being Fe and unavoidable impurities, and has a microstructure containing 70% or more bainite or bainitic ferrite on an area basis.

However, the high-ductility, high-strength cold-rolled steel sheet specified in JP 2003-193190 does not have sufficient elongation. Thus, high-strength galvanized steel sheets having sufficient elongation and excellent stretch frangeability, excellent in formability have not yet been obtained.

It could therefore be helpful to provide a high-strength galvanized steel sheet having excellent mechanical properties such as a TS of 1200 MPa or more, an El of 13% or more, and a hole expansion ratio of 50% or more and to provide a method for manufacturing the same.

We conducted intensive studies on high-strength galvanized steel sheets having a TS of 1200 MPa or more, an El of 13% or more, and a hole expansion ratio of 50% or more and discovered the following:

i) It is effective to produce a microstructure which contains 0% to 10% ferrite, 0% to 10% martensite, and 60% to 95% tempered martensite on an area basis as determined by structure observation and which further contains 5% to 20% retained austenite as determined by X-ray diffractometry in addition to the adjustment of composition.

ii) Such a microstructure is obtained in such a manner that a steel sheet is heated from a temperature 50° C. lower than the $Ac_3$ transformation point to the $Ac_3$ transformation point at an average rate of 2° C./s or less, held at a temperature not lower than the $Ac_3$ transformation point for 10 s or more, cooled to a temperature 100° C. to 200° C. lower than the Ms point at an average rate of 20° C./s or more, and then reheated at 300° C. to 600° C. for 1 to 600 s.

We thus provide a high-strength galvanized steel sheet excellent in formability. The sheet contains 0.05% to 0.5% C, 0.01% to 2.5% Si, 0.5% to 3.5% Mn, 0.003% to 0.100% P, 0.02% or less S, and 0.010% to 0.5% Al on a mass basis, the remainder being Fe and unavoidable impurities, and has a microstructure which contains 0% to 10% ferrite, 0% to 10% martensite, and 60% to 95% tempered martensite on an area basis as determined by structure observation and which further contains 5% to 20% retained austenite as determined by X-ray diffractometry.

The high-strength galvanized steel sheet preferably further contains at least one selected from the group consisting of 0.005% to 2.00% Cr, 0.005% to 2.00% Mo, 0.005% to 2.00% V, 0.005% to 2.00% Ni, and 0.005% to 2.00% Cu on a mass basis. The high-strength galvanized steel sheet preferably further contains at least one selected from the group consisting of 0.01% to 0.20% Ti, 0.01% to 0.20% Nb, 0.0002% to 0.005% B, 0.001% to 0.005% Ca, and 0.001% to 0.005% of a REM on a mass basis.

The high-strength galvanized steel sheet may include an alloyed zinc coating.

The high-strength galvanized steel sheet can be manufactured by the following method: a slab containing the above components is hot-rolled and then cold-rolled into a cold-rolled steel sheet; the cold-rolled steel sheet is annealed in such a manner that the cold-rolled steel sheet is heated from a temperature 50° C. lower than the $Ac_3$ transformation point to the $Ac_3$ transformation point at an average rate of 2° C./s or less, soaked by holding the sheet at a temperature not lower than the $Ac_3$ transformation point for 10 s or more, cooled to a temperature 100° C. to 200° C. lower than the Ms point at an average rate of 20° C./s or more, and then reheated at 300° C. to 600° C. for 1 to 600 s; and the resulting sheet is galvanized.

The method may include alloying a zinc coating formed by galvanizing.

The following sheet can be manufactured: a high-strength galvanized steel sheet having excellent mechanical properties such as a TS of 1200 MPa or more, an El of 13% or more, and a hole expansion ratio of 50% or more. The use of the high-strength galvanized steel sheet for automobile bodies allows automobiles to have a reduced weight and improved corrosion resistance.

DETAILED DESCRIPTION

Our steel sheets and methods will now be described in detail. The unit "%" used herein to describe the content of each component means mass percent unless otherwise specified.

(1) Composition

C: 0.05% to 0.5%

C is an element necessary to produce a second phase such as martensite or tempered martensite to increase TS. When the content of C is less than 0.05%, it is difficult to secure 60% or more tempered martensite on an area basis. On the other hand, when the C content is greater than 0.5%, El and/or spot weldability is deteriorated. Therefore, the C content is 0.05% to 0.5% and preferably 0.1% to 0.3%.

Si: 0.01% to 2.5%

Si is an element effective in improving a TS-El balance by the solid solution hardening of steel and effective in producing retained austenite. The content of Si needs to be 0.01% or more to achieve such effects. When the Si content is greater than 2.5%, El, surface properties, and/or weldability is deteriorated. Therefore, the Si content is 0.01% to 2.5% and preferably 0.7% to 2.0%.

Mn: 0.5% to 3.5%

Mn is an element effective in hardening steel and promotes production of a second phase such as martensite. The content of Mn needs to be 0.5% or more to achieve such an effect. When the Mn content is greater than 3.5%, El is significantly deteriorated and therefore formability is reduced. Therefore, the Mn content is 0.5% to 3.5% and preferably 1.5% to 3.0%.

P: 0.003% to 0.100%

P is an element effective in hardening steel. The content of P needs to be 0.003% or more to achieve such an effect. When the P content is greater than 0.100%, steel is embrittled due to grain boundary segregation and, therefore, deteriorates in impact resistance. Therefore, the P content is 0.03% to 0.100%.

S: 0.02% or less

S is present in the form of an inclusion such as MnS and deteriorates impact resistance and/or weldability. Hence, the content thereof is preferably low. However, the content of S is 0.02% or less in view of manufacturing cost.

Al: 0.010% to 0.5%

Al is an element effective in producing ferrite and effective in improving a TS-El balance. The content of Al needs to be 0.010% or more to achieve such effects. When the Al content is greater than 0.5%, the risk of cracking of a slab during continuous casting is high. Therefore, the Al content is 0.010% to 0.5%.

The remainder is Fe and unavoidable impurities. At least one the following impurities is preferably contained: 0.005% to 2.00% Cr, 0.005% to 2.00% Mo, 0.005% to 2.00% V, 0.005% to 2.00% Ni, 0.005% to 2.00% Cu, 0.01% to 0.20% Ti, 0.01% to 0.20% Nb, 0.0002% to 0.005% B, 0.001% to 0.005% Ca, and 0.001% to 0.005% of a REM. Each of Cr, Mo, V, Ni, and Cu: 0.005% to 2.00%

Cr, Mo, V, Ni, and Cu are elements effective in producing a second phase such as martensite. The content of at least one selected from the group consisting of Cr, Mo, V, Ni, and Cu needs to be 0.005% or more to achieve such an effect. When the content of each of Cr, Mo, V, Ni, and Cu is greater than 2.00%, the effect is saturated and an increase in cost is caused. Therefore, the content of each of Cr, Mo, V, Ni, and Cu is 0.005% to 2.00%.

Each of Ti and Nb: 0.01% to 0.20%

Ti and Nb are elements that each form a carbonitride and are effective in increasing the strength of steel by precipitation hardening. The content of at least one of Ti and Nb needs to be 0.01% or more to achieve such an effect. When the content of each of Ti and Nb is greater than 0.20%, the effect of increasing the strength thereof is saturated and El is reduced. Therefore, the content of each of Ti and Nb is 0.01% to 0.20%.

B: 0.0002% to 0.005%

B is an element that is effective in producing a second phase because B prevents ferrite from being produced from austenite grain boundaries. The content of B needs to be 0.0002% or more to achieve such an effect. When the B content is greater than 0.005%, the effect is saturated and an increase in cost is caused. Therefore, the B content is 0.0002% to 0.005%.

Each of Ca and REM: 0.001% to 0.005%

Ca and the REM are elements effective in improving formability by controlling the morphology of a sulfide. The content of at least one of Ca and the REM needs to be 0.001% or more to achieve such an effect. When the content of each of Ca and the REM is greater than 0.005%, the cleanliness of steel is possibly reduced. Therefore, the content of each of Ca and the REM is 0.001% to 0.005%.

(2) Microstructure

Area Fraction of Ferrite: 0% to 10%

It is difficult to achieve both a TS of 1200 MPa or more and a hole expansion ratio of 50% or more when the area fraction of ferrite is greater than 10%. Therefore, the area fraction of ferrite is 0% to 10%.

Area Fraction of Martensite: 0% to 10%

The hole expansion ratio is remarkably low when the area fraction of martensite is greater than 10%. Therefore, the area fraction of martensite is 0% to 10%.

Area Fraction of Tempered Martensite: 60% to 95%

It is difficult to achieve both a TS of 1200 MPa or more and a hole expansion ratio of 50% or more when the area fraction of tempered martensite is less than 60%. On the other hand, when the area fraction thereof is greater than 95%, the El is remarkably low. Therefore, the area fraction of tempered martensite is 60% to 95%.

Volume Fraction of Retained Austenite: 5% to 20%

Retained austenite is effective in increasing El. The volume fraction of retained austenite needs to be 5% or more to achieve such an effect. However, when the volume fraction thereof is greater than 20%, the hole expansion ratio is remarkably low. Therefore, the volume fraction of retained austenite is 5% to 20%.

Pearlite and/or bainite may be contained in addition to ferrite, martensite, tempered martensite, and retained austenite. When the above microstructure conditions are satisfied, high strength and excellent formability are achieved.

The area fraction of each of ferrite, martensite, and tempered martensite is the fraction of the area of each phase in the area of an observed region. The area fraction of each of ferrite, martensite, and tempered martensite is determined using a commercially available image-processing program in such a manner that a surface of a steel sheet parallel to the thickness direction thereof is polished and then eroded with 3% nital and a location spaced from the edge of the surface at a distance equal to one-fourth of the thickness of the steel sheet is observed with a SEM (scanning electron microscope) at a magnification of 1500 times. The volume fraction of retained austenite is determined in such a manner that a surface of the steel sheet exposed by polishing the steel sheet to a depth equal to one-fourth of the thickness of the steel sheet is chemically polished by 0.1 mm and then analyzed by measuring the integral intensity of each of the (200) plane, (220) plane, and (311) plane of fcc iron and that of the (200) plane, (211) plane, and (220) plane of bcc iron with an X-ray diffractometer using Mo—Kα.

(3) Manufacturing Conditions

A high-strength galvanized steel sheet can be manufactured in such a manner that, for example, a slab containing the above components is hot-rolled and then cold-rolled into a cold-rolled steel sheet; the cold-rolled steel sheet is annealed in such a manner that the cold-rolled steel sheet is heated from a temperature 50° C. lower than the $Ac_3$ transformation point to the $Ac_3$ transformation point at an average rate of 2° C./s or less, soaked by holding the heated steel sheet at a temperature not lower than the $Ac_3$ transformation point for 10 s or more, cooled to a temperature 100° C. to 200° C. lower than the Ms point at an average rate of 20° C./s or more, and then reheated at 300° C. to 600° C. for 1 to 600 s; and the resulting sheet is galvanized.

Heating Conditions During Annealing: Heating from a Temperature 50° C. Lower than the $Ac_3$ Transformation Point to the $Ac_3$ Transformation Point at an Average Rate of 2° C./s or Less When the average rate of heating the sheet from a temperature 50° C. lower than the $Ac_3$ transformation point to the $Ac_3$ transformation point is greater than 2° C./s, the microstructure specified herein is not obtained because austenite grains formed during soaking have a very small size. Therefore, production of ferrite is promoted during cooling. Therefore, the sheet needs to be heated from a temperature 50° C. lower than the $Ac_3$ transformation point to the $Ac_3$ transformation point at an average rate of 2° C./s or less.

Soaking Conditions During Annealing: Soaking by Holding the Sheet at a Temperature not Lower than the $Ac_3$ Transformation Point for 10 s or More When the soaking temperature is lower than the $Ac_3$ transformation point or the holding time is less than 10 s, the microstructure specified herein is not obtained because the production of austenite is insufficient. Therefore, the sheet needs to be soaked by holding the sheet at a temperature not lower than the $Ac_3$ transformation point for 10 s or more. The upper limit of the soaking temperature or the upper limit of the holding time is not particularly limited. However, soaking at a temperature not less than 950° C. for 600 s or more causes an obtained effect to be saturated and causes an increase in cost. Therefore, the soaking temperature is preferably lower than 950° C. and the holding time is preferably less than 600 s.

Cooling Conditions During Annealing: Cooling from the Soaking Temperature to a Temperature 100° C. to 200° C. lower than the Ms Point at an Average Rate of 20° C./s or More When the average rate of cooling the sheet from the soaking temperature to a temperature 100° C. to 200° C. lower than the Ms point is less than 20° C./s, the microstructure specified herein is not obtained because a large amount of ferrite is produced during cooling. Therefore, the sheet needs to be cooled at an average rate of 20° C./s or more. The upper limit of the average cooling rate is not particularly limited and is preferably 200° C./s or less because the shape of the steel sheet is distorted or it is difficult to control the ultimate cooling temperature, that is, a temperature 100° C. to 200° C. lower than the Ms point.

The ultimate cooling temperature is the most important condition to obtain the microstructure specified herein. Austenite is partly transformed into martensite by cooling the sheet to the ultimate cooling temperature. Martensite is transformed into tempered martensite and untransformed austenite is transformed into retained austenite, martensite, or bainite by reheating or plating the resulting sheet. When the ultimate cooling temperature is higher than a temperature 100° C. lower than the Ms point or lower than a temperature 200° C. lower than the Ms point, martensitic transformation is insufficient or the amount of untransformed austenite is extremely small, respectively. Hence, the microstructure specified herein is not obtained. Therefore, the ultimate cooling temperature needs to be a temperature 100° C. to 200° C. lower than the Ms point.

The Ms point is the temperature at which the transformation of austenite into martensite starts and can be determined from a change in the coefficient of linear expansion of steel during cooling.

Reheating Conditions During Annealing: Reheating at 300° C. to 600° C. for 1 to 600 s After the sheet is cooled to the ultimate cooling temperature, the sheet is reheated at 300° C. to 600° C. for 1 to 600 s, whereby martensite produced during cooling is transformed into tempered martensite and untransformed austenite is stabilized in the form of retained austenite because of the concentration of C carbon into untransformed austenite or is partly transformed into martensite. When the reheating temperature is lower than 300° C. or higher than 600° C., the tempering of martensite and the stabilization of retained austenite are insufficient and untrans-formed austenite is likely to be transformed into pearlite, respectively. Hence, the microstructure specified herein is not obtained. Therefore, the reheating temperature is 300° C. to 600° C.

When the holding time is less than 1 s or greater than 600 s, the tempering of martensite is insufficient or untransformed austenite is likely to be transformed into pearlite, respectively. Hence, the microstructure specified herein is not obtained. Therefore, the holding time is 1 to 600 s.

Other manufacturing conditions are not particularly limited and are preferably as described below.

The slab is preferably manufactured by a continuous casting process for the purpose of preventing macro-segregation and may be manufactured by an ingot-making process or a thin slab-casting process. The slab may be hot-rolled in such a manner that the slab is cooled to room temperature and then reheated or in such a manner that the slab is placed into a furnace without cooling the slab to room temperature. Alternatively, the slab may be treated by such an energy-saving process that the slab is held hot for a slight time and then immediately hot-rolled. In the case where the slab is heated, the heating temperature thereof is preferably 1100° C. or higher because carbides are melted or rolling force is prevented from increasing. Furthermore, the heating temperature of the slab is preferably 1300° C. or lower because scale loss is prevented from increasing.

In the case where the slab is hot-rolled, a roughly rolled bar may be heated such that any problems during rolling are prevented even if the heating temperature of the slab is low. Furthermore, a so-called "continuous rolling process," in which rough bars are bonded to each other and then subjected to continuous finish rolling, may be used. Finish rolling is preferably performed at a temperature not lower than the $Ar_3$ transformation point because finish rolling may increase anisotropy and, therefore, reduce the formability of the cold-rolled and annealed sheet. To reduce rolling force and/or to achieve a uniform shape and material, lubrication rolling is preferably performed in such a manner that the coefficient of friction during all or some finish rolling passes is 0.10 to 0.25.

In view of temperature control and prevention of decarburization, the hot-rolled steel sheet is coiled at 450° C. to 700° C.

After the coiled steel sheet is descaled by pickling or the like, the resulting steel sheet is preferably cold-rolled at a reduction rate of 40% or more, annealed under the above conditions, and then galvanized. The coiled steel sheet may be subjected to hot band annealing to reduce the rolling force during cold rolling.

Galvanizing is performed in such a manner that the steel sheet is immersed in a plating bath maintained at 440° C. to 500° C. and the amount of coating thereon is adjusted by gas wiping. The plating bath contains 0.12% to 0.22% or 0.08% to 0.18% Al when a zinc coating is alloyed or is not alloyed, respectively. When the zinc coating is alloyed, the zinc coating is maintained at 450° C. to 600° C. for 1 to 30 s.

The galvanized steel sheet or the steel sheet having the alloyed zinc coating may be temper-rolled for the purpose of adjusting the shape and/or surface roughness thereof or may be coated with resin or oil.

EXAMPLES

Steels A to P containing components shown in Table 1 were produced in a converter and then cast into slabs by a continuous casting process. Each slab was hot-rolled into a 3.0 mm-thickness strip at a finishing temperature of 900° C. The hot-rolled strip was cooled at a rate of 10° C./s and then coiled at 600° C. The resulting strip was pickled and then cold-rolled into a 1.2 mm-thickness sheet. The sheet was annealed under conditions shown in Table 2 or 3 and then immersed in a plating bath maintained at 460° C. such that a coating with a mass per unit area of 35 to 45 g/m$^2$ was formed thereon. The coating was alloyed at 520° C. The resulting sheet was cooled at a rate of 10° C./s, whereby a corresponding one of plated steel sheets 1 to 30 was manufactured. As shown in FIGS. 2 and 3, some of the plated steel sheets were not subjected to alloying. The obtained plated steel sheets were measured for the area fraction of each of ferrite, martensite, and tempered martensite and the volume fraction of retained austenite in the above-mentioned manner. JIS #5 tensile test specimens perpendicular to the rolling direction were taken from the sheets and then subjected to a tensile test according to JIS Z 2241. Furthermore, 150 mm-square specimens were taken from the sheets and then subjected to a hole-expanding test according to JFS T 1001 (a standard of The Japan Iron and Steel Federation) three times, whereby the average hole expansion ratio (%) of each specimen was determined and the stretch frangeability thereof was evaluated.

Tables 4 and 5 show the results. It is clear that the plated steel sheets manufactured in our examples have a TS of 1200 MPa or more, an El of 13% or more, and a hole expansion ratio of 50% or more and are excellent in formability.

TABLE 1

| | Components (mass percent) | | | | | | | | | | | | | | | | Ac3 transformation point | |
|---|---|---|---|---|---|---|---|---|---|---|---|---|---|---|---|---|---|---|
| Steels | C | Si | Mn | P | S | Al | Cr | Mo | V | Ni | Cu | Ti | Nb | B | Ca | REM | (° C.) | Remarks |
| A | 0.15 | 1.0 | 2.3 | 0.020 | 0.003 | 0.035 | — | — | — | — | — | — | — | — | — | — | 853 | Within the scope of the present invention |
| B | 0.40 | 1.5 | 2.0 | 0.015 | 0.002 | 0.037 | — | — | — | — | — | — | — | — | — | — | 822 | Within the scope of the present invention |
| C | 0.20 | 0.7 | 2.6 | 0.017 | 0.004 | 0.400 | — | — | — | — | — | — | — | — | — | — | 871 | Within the scope of the present invention |
| D | 0.07 | 0.02 | 3.0 | 0.019 | 0.002 | 0.041 | 0.50 | — | — | — | — | — | — | — | — | — | 776 | Within the scope of the present invention |
| E | 0.25 | 2.0 | 2.0 | 0.025 | 0.003 | 0.036 | — | 0.30 | — | — | — | — | — | — | — | — | 887 | Within the scope of the present invention |
| F | 0.12 | 0.3 | 1.4 | 0.013 | 0.005 | 0.028 | — | — | 0.10 | — | — | — | — | — | — | — | 852 | Within the scope of the present invention |
| G | 0.22 | 1.0 | 1.2 | 0.008 | 0.006 | 0.031 | — | — | — | 0.60 | — | — | — | — | — | — | 853 | Within the scope of the present invention |
| H | 0.16 | 0.6 | 2.7 | 0.014 | 0.002 | 0.033 | — | — | — | — | 0.20 | — | — | — | — | — | 814 | Within the scope of the present invention |
| I | 0.08 | 1.0 | 2.2 | 0.007 | 0.003 | 0.025 | — | — | — | — | — | 0.04 | — | — | — | — | 872 | Within the scope of the present invention |

TABLE 1-continued

| Steels | Components (mass percent) C | Si | Mn | P | S | Al | Cr | Mo | V | Ni | Cu | Ti | Nb | B | Ca | REM | Ac3 transformation point (° C.) | Remarks |
|---|---|---|---|---|---|---|---|---|---|---|---|---|---|---|---|---|---|---|
| J | 0.12 | 1.1 | 1.9 | 0.007 | 0.002 | 0.033 | — | — | — | — | — | — | 0.05 | — | — | — | 879 | Within the scope of the present invention |
| K | 0.10 | 1.5 | 2.7 | 0.014 | 0.001 | 0.042 | — | — | — | — | — | 0.03 | — | 0.001 | — | — | 878 | Within the scope of the present invention |
| L | 0.10 | 0.6 | 1.9 | 0.021 | 0.005 | 0.015 | — | — | — | — | — | — | — | — | 0.003 | — | 856 | Within the scope of the present invention |
| M | 0.16 | 1.2 | 2.9 | 0.006 | 0.004 | 0.026 | — | — | — | — | — | — | — | — | — | 0.002 | 842 | Within the scope of the present invention |
| N | 0.03 | 1.4 | 2.2 | 0.012 | 0.003 | 0.028 | — | — | — | — | — | — | — | — | — | — | 908 | Outside the scope of the present invention |
| O | 0.20 | 1.0 | 4.0 | 0.010 | 0.002 | 0.046 | — | — | — | — | — | — | — | — | — | — | 789 | Outside the scope of the present invention |
| P | 0.15 | 0.5 | 0.3 | 0.019 | 0.004 | 0.036 | — | — | — | — | — | — | — | — | — | — | 804 | Outside the scope of the present invention |

TABLE 2

| Plated steel sheets | Steels | Annealing conditions Heating rate (° C./s) | Soaking temperature (° C.) | Soaking time (s) | Cooling time (° C./s) | Ultimate cooling temperature (° C.) | Reheating temperature (° C.) | Reheating time (s) | Ms point (° C.) | Alloying | Remarks |
|---|---|---|---|---|---|---|---|---|---|---|---|
| 1 | A | 1.2 | 870 | 60 | 30 | 250 | 420 | 50 | 405 | Performed | Example |
| 2 | | 2.5 | 870 | 60 | 30 | 250 | 420 | 50 | 386 | Performed | Comparative example |
| 3 | | 1.5 | 750 | 60 | 70 | 240 | 400 | 40 | 380 | Performed | Comparative example |
| 4 | | 1.4 | 870 | 60 | 60 | 80 | 420 | 40 | 400 | Performed | Comparative example |
| 5 | B | 1.9 | 840 | 90 | 100 | 220 | 430 | 60 | 330 | Performed | Example |
| 6 | | 1.0 | 840 | 5 | 80 | 200 | 430 | 60 | 315 | Performed | Comparative example |
| 7 | | 1.4 | 860 | 40 | 90 | 50 | 400 | 60 | 320 | Performed | Comparative example |
| 8 | C | 1.1 | 890 | 120 | 25 | 270 | 440 | 50 | 400 | Not performed | Example |
| 9 | | 1.1 | 900 | 60 | 5 | 200 | 450 | 50 | 375 | Not performed | Comparative example |
| 10 | | 1.1 | 900 | 60 | 30 | 30 | 450 | 50 | 400 | Not performed | Comparative example |
| 11 | D | 0.7 | 870 | 150 | 70 | 230 | 320 | 70 | 395 | Performed | Example |
| 12 | | 0.9 | 880 | 60 | 150 | 40 | 320 | 70 | 395 | Performed | Comparative example |
| 13 | | 1.2 | 880 | 90 | 100 | 350 | 350 | 70 | 395 | Performed | Comparative example |
| 14 | E | 0.5 | 900 | 75 | 80 | 240 | 400 | 30 | 380 | Performed | Example |
| 15 | | 0.5 | 900 | 60 | 80 | 240 | 250 | 60 | 380 | Performed | Comparative example |
| 16 | | 0.5 | 910 | 75 | 80 | 200 | 670 | 60 | 380 | Performed | Comparative example |

TABLE 3

| Plated steel sheets | Steels | Annealing conditions Heating rate (° C./s) | Soaking temperature (° C.) | Soaking time (s) | Cooling time (° C./s) | Ultimate cooling temperature (° C.) | Reheating temperature (° C.) | Reheating time (s) | Ms point (° C.) | Alloying | Remarks |
|---|---|---|---|---|---|---|---|---|---|---|---|
| 17 | F | 0.8 | 870 | 240 | 90 | 310 | 400 | 90 | 450 | Performed | Example |
| 18 | | 1.2 | 880 | 240 | 90 | 300 | 350 | 0 | 450 | Performed | Comparative example |
| 19 | | 1.5 | 870 | 240 | 90 | 300 | 450 | 900 | 450 | Performed | Comparative example |
| 20 | G | 1.8 | 870 | 60 | 100 | 250 | 500 | 30 | 415 | Performed | Example |
| 21 | H | 1.6 | 850 | 120 | 90 | 200 | 400 | 30 | 385 | Performed | Example |

TABLE 3-continued

| Plated steel sheets | Steels | Annealing conditions: Heating rate (° C./s) | Soaking temperature (° C.) | Soaking time (s) | Cooling time (° C./s) | Ultimate cooling temperature (° C.) | Reheating temperature (° C.) | Reheating time (s) | Ms point (° C.) | Alloying | Remarks |
|---|---|---|---|---|---|---|---|---|---|---|---|
| 22 | I | 0.8 | 910 | 75 | 150 | 260 | 500 | 45 | 435 | Performed | Example |
| 23 | J | 0.9 | 880 | 45 | 80 | 240 | 400 | 20 | 435 | Not performed | Example |
| 24 | | 2.3 | 880 | 45 | 80 | 240 | 400 | 20 | 418 | Not performed | Comparative example |
| 25 | K | 0.5 | 900 | 200 | 100 | 270 | 550 | 10 | 410 | Performed | Example |
| 26 | L | 0.8 | 890 | 120 | 150 | 260 | 400 | 60 | 440 | Performed | Example |
| 27 | M | 1.2 | 870 | 90 | 150 | 200 | 400 | 20 | 380 | Not performed | Example |
| 28 | N | 1.2 | 920 | 60 | 30 | 300 | 400 | 60 | 450 | Performed | Comparative example |
| 29 | O | 1.2 | 850 | 90 | 80 | 200 | 400 | 30 | 325 | Performed | Comparative example |
| 30 | P | 1.2 | 940 | 75 | 80 | 340 | 400 | 120 | 480 | Performed | Comparative example |

TABLE 4

| Plated steel sheets | Microstructure*: F area fraction (%) | M area fraction (%) | Tempered martensite area fraction (%) | Retained γ Volume fraction (%) | Others | Tensile properties: TS (MPa) | El (%) | TS × El (MPa · %) | Hole expansion ratio (%) | Remarks |
|---|---|---|---|---|---|---|---|---|---|---|
| 1 | 0 | 0 | 82 | 8 | B | 1349 | 15 | 20235 | 60 | Example |
| 2 | 30 | 0 | 54 | 10 | B | 960 | 22 | 21120 | 35 | Comparative example |
| 3 | 50 | 0 | 39 | 11 | — | 808 | 28 | 22610 | 30 | Comparative example |
| 4 | 0 | 0 | 97 | 3 | — | 1397 | 8 | 11172 | 55 | Comparative example |
| 5 | 0 | 5 | 70 | 13 | B | 1558 | 16 | 24928 | 60 | Example |
| 6 | 20 | 0 | 30 | 2 | B + P | 830 | 16 | 13280 | 35 | Comparative example |
| 7 | 0 | 0 | 98 | 2 | — | 1587 | 7 | 11106 | 70 | Comparative example |
| 8 | 0 | 0 | 76 | 10 | B | 1368 | 16 | 21888 | 70 | Example |
| 9 | 40 | 0 | 51 | 9 | — | 998 | 19 | 18953 | 25 | Comparative example |
| 10 | 0 | 0 | 98 | 2 | — | 1482 | 8 | 11856 | 60 | Comparative example |
| 11 | 0 | 5 | 84 | 6 | B | 1311 | 14 | 18354 | 65 | Example |
| 12 | 0 | 0 | 98 | 2 | — | 1378 | 8 | 11020 | 60 | Comparative example |
| 13 | 0 | 45 | 39 | 8 | B | 1463 | 14 | 20482 | 40 | Comparative example |
| 14 | 5 | 0 | 75 | 12 | B | 1454 | 17 | 24710 | 50 | Example |
| 15 | 5 | 18 | 75 | 2 | — | 1492 | 7 | 10441 | 40 | Comparative example |
| 16 | 5 | 0 | 82 | 0 | P | 1283 | 9 | 11543 | 30 | Comparative example |

*F represents ferrite, M represents martensite, γ represents austenite, P represents pearlite, and B represents bainite.

TABLE 5

| Plated steel sheets | Microstructure*: F area fraction (%) | M area fraction (%) | Tempered martensite area fraction (%) | Retained γ Volume fraction (%) | Others | Tensile properties: TS (MPa) | El (%) | TS × El (MPa · %) | Hole expansion ratio (%) | Remarks |
|---|---|---|---|---|---|---|---|---|---|---|
| 17 | 0 | 5 | 79 | 6 | B | 1216 | 15 | 18240 | 60 | Example |
| 18 | 0 | 17 | 81 | 2 | — | 1245 | 10 | 12445 | 40 | Comparative example |
| 19 | 0 | 0 | 81 | 2 | B | 1197 | 10 | 11970 | 60 | Comparative example |
| 20 | 5 | 0 | 80 | 15 | — | 1444 | 17 | 24548 | 55 | Example |
| 21 | 0 | 0 | 87 | 8 | B | 1520 | 13 | 19760 | 60 | Example |
| 22 | 0 | 0 | 85 | 8 | B | 1226 | 16 | 19608 | 65 | Example |
| 23 | 0 | 0 | 88 | 7 | B | 1416 | 13 | 18402 | 55 | Example |
| 24 | 40 | 0 | 52 | 8 | — | 945 | 21 | 19845 | 30 | Comparative example |
| 25 | 0 | 8 | 79 | 8 | B | 1273 | 16 | 20368 | 60 | Example |
| 26 | 0 | 0 | 86 | 9 | B | 1207 | 17 | 20511 | 70 | Example |
| 27 | 0 | 5 | 86 | 9 | — | 1416 | 15 | 21233 | 55 | Example |
| 28 | 60 | 0 | 32 | 1 | B | 656 | 24 | 15732 | 60 | Comparative example |
| 29 | 0 | 22 | 75 | 3 | — | 1444 | 9 | 12996 | 35 | Comparative example |
| 30 | 30 | 0 | 55 | 0 | B | 884 | 15 | 13253 | 30 | Comparative example |

*F represents ferrite, M represents martensite, γ represents austenite, P represents pearlite, and B represents bainite.

The invention claimed is:

1. A high-strength galvanized steel sheet excellent in formability, comprising 0.05% to 0.5% C, 0.01% to 2.5% Si, 0.5% to 3.5% Mn, 0.003% to 0.100% P, 0.02% or less S, and 0.010% to 0.5% Al on a mass basis, the remainder being Fe and unavoidable impurities, the sheet having a microstructure which contains 0% to 10% ferrite, 0% to 10% martensite, and 60% to 95% tempered martensite on an area basis as determined by structure observation and which further contains 5% to 20% retained austenite as determined by X-ray diffractometry, a tensile strength of 1200 MPa or more, a hole expansion ratio of 50% or more and an elongation of 13% to 17%.

2. The high-strength galvanized steel sheet according to claim 1, further comprising at least one selected from the group consisting of 0.005% to 2.00% Cr, 0.005% to 2.00% Mo, 0.005% to 2.00% V, 0.005% to 2.00% Ni, and 0.005% to 2.00% Cu on a mass basis.

3. The high-strength galvanized steel sheet according to claim 1, further comprising at least one of 0.01% to 0.20% Ti and 0.01% to 0.20% Nb on a mass basis.

4. The high-strength galvanized steel sheet according to claim 1, further comprising 0.0002% to 0.005% B on a mass basis.

5. The high-strength galvanized steel sheet according to claim 1, further comprising at least one of 0.001% to 0.005% Ca and 0.001% to 0.005% of a REM on a mass basis.

6. The high-strength galvanized steel sheet according to claim 1, comprising an alloyed zinc coating.

7. A method of manufacturing a high-strength galvanized steel sheet excellent in formability, comprising:

subjecting a slab containing the components specified in claim 1 to hot rolling and then cold rolling to form a cold-rolled steel sheet;

annealing the cold-rolled steel sheet by heating the sheet from a temperature 50° C. lower than the $Ac_3$ transformation point to the $Ac_3$ transformation point at an average rate of 2° C./s or less, soaking the sheet by holding at a temperature not lower than the $Ac_3$ transformation point for 10 s or more, cooling the sheet to a temperature 100° C. to 200° C. lower than the Ms point at an average rate of 20° C./s or more, and then reheating the sheet at 300° C. to 600° C. for 1 to 600 s; and galvanizing the resulting sheet.

8. The method according to claim 7, further comprising alloying a zinc coating formed by galvanizing.

9. The high-strength galvanized steel sheet according to claim 2, further comprising at least one of 0.01% to 0.20% Ti and 0.01% to 0.20% Nb on a mass basis.

10. The high-strength galvanized steel sheet according to claim 2, further comprising 0.0002% to 0.005% B on a mass basis.

11. The high-strength galvanized steel sheet according to claim 3, further comprising 0.0002% to 0.005% B on a mass basis.

12. The high-strength galvanized steel sheet according to claim 2, further comprising at least one of 0.001% to 0.005% Ca and 0.001% to 0.005% of a REM on a mass basis.

13. The high-strength galvanized steel sheet according to claim 3, further comprising at least one of 0.001% to 0.005% Ca and 0.001% to 0.005% of a REM on a mass basis.

14. The high-strength galvanized steel sheet according to claim 4, further comprising at least one of 0.001% to 0.005% Ca and 0.001% to 0.005% of a REM on a mass basis.

15. The high-strength galvanized steel sheet according to claim 2, comprising an alloyed zinc coating.

16. The high-strength galvanized steel sheet according to claim 3, comprising an alloyed zinc coating.

17. The high-strength galvanized steel sheet according to claim 4, comprising an alloyed zinc coating.

18. The high-strength galvanized steel sheet according to claim 5, comprising an alloyed zinc coating.

19. A method of manufacturing a high-strength galvanized steel sheet excellent in formability, comprising:

subjecting a slab containing the components specified in claim 2 to hot rolling and then cold rolling to form a cold-rolled steel sheet;

annealing the cold-rolled steel sheet by heating the sheet from a temperature 50° C. lower than the $Ac_3$ transformation point to the $Ac_3$ transformation point at an average rate of 2° C./s or less, soaking the sheet by holding at a temperature not lower than the $Ac_3$ transformation point for 10 s or more, cooling the sheet to a temperature 100° C. to 200° C. lower than the Ms point at an average rate of 20° C./s or more, and then reheating the sheet at 300° C. to 600° C. for 1 to 600 s; and galvanizing the resulting sheet.

20. A method of manufacturing a high-strength galvanized steel sheet excellent in formability, comprising:

subjecting a slab containing the components specified in claim 3 to hot rolling and then cold rolling to form a cold-rolled steel sheet;

annealing the cold-rolled steel sheet by heating the sheet from a temperature 50° C. lower than the $Ac_3$ transformation point to the $Ac_3$ transformation point at an average rate of 2° C./s or less, soaking the sheet by holding at a temperature not lower than the $Ac_3$ transformation point for 10 s or more, cooling the sheet to a temperature 100° C. to 200° C. lower than the Ms point at an average rate of 20° C./s or more, and then reheating the sheet at 300° C. to 600° C. for 1 to 600 s; and galvanizing the resulting sheet.

* * * * *